US006877432B2

(12) United States Patent
Thomson et al.

(10) Patent No.: US 6,877,432 B2
(45) Date of Patent: Apr. 12, 2005

(54) DELIVERY OF EMULSION EXPLOSIVES

(75) Inventors: Stephen Thomson, Merewether (AU); David Brian Kay, Tenambit (AU)

(73) Assignee: Orica Explosives Technology PTY LTD, Melbourne (AU)

( * ) Notice: Subject to any disclaimer, the term of this patent is extended or adjusted under 35 U.S.C. 154(b) by 0 days.

(21) Appl. No.: 10/312,695

(22) PCT Filed: Oct. 4, 2001

(86) PCT No.: PCT/AU01/01252

§ 371 (c)(1),
(2), (4) Date: Mar. 21, 2003

(87) PCT Pub. No.: WO02/29353

PCT Pub. Date: Apr. 11, 2002

(65) Prior Publication Data

US 2003/0159610 A1 Aug. 28, 2003

(30) Foreign Application Priority Data

Oct. 4, 2000 (AU) ..... PR0547

(51) Int. Cl.[7] ..... F42B 3/00
(52) U.S. Cl. ..... 102/313
(58) Field of Search ..... 102/313; 86/70.15

(56) References Cited

U.S. PATENT DOCUMENTS 4,585,496 A * 4/1986 Honeyman et al. ..... 149/21
4,669,783 A * 6/1987 Kolle ..... 299/16
4,671,160 A 6/1987 Kakino et al.
4,913,233 A * 4/1990 Fitzgibbon, Jr. ..... 166/285
4,966,077 A * 10/1990 Halliday et al. ..... 102/313
5,099,763 A * 3/1992 Coursen et al. ..... 102/313
5,105,743 A * 4/1992 Tano et al. ..... 102/313
5,192,819 A * 3/1993 Baumgartner ..... 86/20.15
5,584,222 A * 12/1996 Engsbr.ang.ten et al. .. 86/20.15
5,610,358 A * 3/1997 Eagar et al. ..... 86/21
5,686,685 A * 11/1997 McDonald et al. ..... 86/20.15
5,712,440 A * 1/1998 Eagar et al. ..... 86/20.15
5,874,688 A * 2/1999 Lubbe et al. ..... 86/20.15
6,210,122 B1 * 4/2001 Br.o slashed.ndbo ..... 417/55
6,557,448 B2 * 5/2003 Delagey et al. ..... 86/20.15

FOREIGN PATENT DOCUMENTS

EP 792834 A 3/1997

OTHER PUBLICATIONS

Derwent Abstract Accession No. 97–077725/07, ZA 9509538 A (AECI Explosives Ltd) Dec. 31, 1996.
Derwent Abstract Accession No. 96–393749/39, ZA 9509537 A (AECI Explosives Ltd) Aug. 28, 1996.

* cited by examiner

*Primary Examiner*—Teri P. Luu
*Assistant Examiner*—Jordan Lofdahl
(74) *Attorney, Agent, or Firm*—Birch, Stewart, Kolasch & Birch, LLP

(57) ABSTRACT

Apparatus for delivering an emulsion explosives composition comprising unpressurized vessel (10) for storing or supplying the explosives composition to pressure chamber (1); sealable chamber inlet (2) for charging chamber (1) with emulsion explosives composition from vessel (10); and chamber outlet (4). Fluid pressure opening (6) applies a discharge pressure to chamber (1) for delivering emulsion explosives composition through outlet (4) to delivery hose (11) for charging blast holes. The apparatus is characterized by pressure chamber (1) having a maximum operating pressure and a volume such that the pressure volume (pV) value of chamber (1) is less than 10 MPaL.

15 Claims, 2 Drawing Sheets

DELIVERY OF EMULSION EXPLOSIVES

This application is the national phase under 35 U.S.C. § 371 of PCT International Application No. PCT/AU01/01252 which has an International filing date of Oct. 4, 2001, which designated the United States of America.

BACKGROUND OF THE INVENTION

1. Field of the Invention

The present invention relates to the delivery of emulsion explosives compositions, including non-sensitised emulsions for explosives' use. In particular, the present invention relates to an apparatus and process for charging a blasthole with an emulsion explosives composition and/or, for example, for transferring emulsion explosives composition from one container to another.

2. Description of the Related Art

The delivery of many types of explosives is typically conducted by the use of pumps such as piston pumps and progressive cavity pumps because of the relatively high pressures usually required. However, the passage of emulsion explosives compositions through these pumps, even in non-sensitised condition, is potentially hazardous as failures in the pumping mechanisms can lead to excessive heat or pressure being applied to the material and can cause accidental explosion.

It has been proposed to alleviate these disadvantages in some circumstances by delivering emulsion explosives compositions pneumatically. Pneumatic loading of one of the most common forms of commercial explosives, ammonium nitrate/fuel oil mixtures (ANFO), is well known. ANFO is a dry explosive with good flow qualities and delivery into a borehole is commonly performed through a valved outlet in the bottom of a pressure vessel containing the ANFO at a pressure in the range of 200–600 KPa.

As described in International Patent Application WO 98/10237, adopting a similar proposal for emulsion explosives compositions can remove control in the amount of material loaded into the borehole and produce undesirable splash and waste at the required pressures. In WO 98/10237 these disadvantages are proposed to be alleviated by adopting an incompressible liquid such as water to pressurise a substantial volume of the emulsion explosives composition in a pressure kettle.

The use of water for charging blastholes with emulsion explosives compositions is undesirable because the water can be absorbed into the emulsion, with even small absorbed amounts reducing the blasting energy of the emulsion, increasing the critical diameter and reducing the sensitivity of the emulsion. Additionally, large volumes of potentially contaminated water must then be disposed of.

The pneumatic charging of emulsion explosives compositions is also described in British Patent Application GB 2204343. In this proposal, a non-explosive base emulsion and a gassing solution are transferred into a loading hose from respective hoppers by means of compressed air. They are mixed in a homogeniser at an outlet end of a lance connected to the hose. Prior to being mixed together the gassing solution surrounds the base emulsion in the hose to lubricate the passage of the base emulsion therethrough and allow lower pressures to be used in the hoppers. The supply of compressed air to the hoppers, and therefore the delivery of emulsion explosive from the lance, is controlled by a shut-off value on the lance which is biased into its closed condition. Thus an operator adjacent to the blasthole collar must manually hold the shut-off valve open.

It is suggested in GB 2204343 that it is preferred to use respective pumps for feeding the base emulsion and gassing solution into the loading hose, in place of compressed air in the hoppers.

International patent application WO 97/48966 also proposes the pneumatic delivery of emulsion explosives compositions to boreholes. The arrangement described is similar to that in GB 2204343 except that lubrication of the material being delivered is provided by an annular stream of water around the material in the delivery hose. Additional ways of maintaining relatively low extrusion pressures are described, including keeping the internal diameter of the delivery hose and associated components as large as possible. Compressed air pressures of about 240 and 550 KPa are described.

One of the difficulties associated with all of the above proposals for delivering emulsion explosives compositions pneumatically remains the control of the amount of material delivered, given the compressibility of the gas.

The metered delivery of explosives using pneumatic discharge is described in U.S. Pat. No. 5,811,711 which proposes the use of complex metering means, control means and a programmable controller, the metering is then performed by timing the flow or delivery of the explosives.

As described in the aforementioned patent specifications, with conventional pneumatic delivery of emulsion explosives compositions, the whole inventory of the composition available for delivery is pressurised leading to complex apparatus whose use underground is restricted to qualified personnel. The pressurised vessels from which the composition is delivered are also subject to strict controls leading to additional expense both in manufacturing them and in maintaining them.

SUMMARY OF THE INVENTION

It is an object of the present invention to alleviate these disadvantages of previous proposals.

According to the present invention there is provided apparatus for delivering emulsion explosives composition, the apparatus comprising an unpressurised vessel for storing or supplying the composition to a pressure chamber, a sealable inlet to the chamber for charging the chamber with emulsion explosives composition from the vessel, an outlet from the chamber, and a fluid pressure opening to the chamber for applying a discharge pressure to the chamber for delivering emulsion explosives composition in the chamber through said outlet, wherein the apparatus has a maximum operating pressure and a volume of the pressure chamber such that it has a pressure volume (pV) value of less than 10 MPaL.

The present invention also provides a process for the delivery of emulsion explosives composition comprising the steps of:

a) storing a supply of the composition in an unpressurised vessel;

b) charging a pressure chamber with emulsion explosives composition from the vessel through a sealable inlet to the chamber; and c) applying a discharge pressure to the chamber to discharge emulsion explosives composition in the chamber through an outlet from the chamber;

wherein the discharge pressure and the volume of the pressure chamber are such that the pressure chamber has a pressure volume (pV) value of less than 10 MPaL.

As used herein, the term "emulsion explosives composition" shall be understood to include sensitised emulsion explosives, base emulsions for emulsion explosives, that is unsensitised emulsion phases, as well as slurry and melt-in-fuel explosives. The apparatus and process of the invention may be used for base emulsions for water-in-oil emulsion explosives, optionally including particulate matter such as ammonium nitrate prills. The apparatus and process are most commonly used to deliver a pre-sensitised composition, that is, a base emulsion premixed with a sensitising agent, such as glass microballoons, to produce an emulsion explosive. These types of emulsion explosives are well known to those skilled in the art. The base emulsion tends to be too low in viscosity to retain gas bubbles which are commonly used in chemical gassing techniques.

By the present invention, a very simple system may be adopted for delivering emulsion explosives composition without the use of positive displacement pumps such as piston pumps and progressive cavity pumps and without the risk of pressurising substantial volumes of the composition. By selecting a pV value of less than 10 MPaL, the pressure chamber avoids classification as a pressure vessel and the strict control regulations which apply to pressure vessels. In some countries a different pV value may apply to the pressure vessel classification, in which case the maximum pV value in the invention may be adjusted accordingly. The pV value is calculated by multiplying the maximum or rated operating pressure of the pressure chamber (MPa) by the volume of the pressure chamber in liters.

The non-pressure vessel rating of the pressure chamber means that the apparatus and process of the invention may be used underground by unskilled mine operators.

Advantageously, the apparatus and process of the present invention may be used to load a blasthole with the emulsion explosives composition. However, the invention may alternatively be used to deliver the emulsion explosives composition from the chamber to some other location such as a holding or delivery vessel. The invention in its preferred embodiment has particular advantage where relatively small volumes of explosives are required, especially in wet conditions, such as in development mining and similar activities in underground mines, where packaged explosives may otherwise be used. By way of example, at a discharge pressure of 700 KPa, the maximum volume of the pressure chamber would be about 14.25 liters in order to maintain a pV value of below 10 MPaL.

Where the emulsion explosives composition in the chamber is unsensitised, it may be sensitised in known manner downstream of the chamber, for example as described in GB 2204343 or International patent application WO 97/24298.

The chamber must be capable of safely containing the emulsion explosives composition at the discharge pressure. The material of construction of the vessel containing the chamber is selected to withstand the discharge pressure and also to be unreactive with the emulsion explosives composition. The material should also provide sufficient structural robustness in order to withstand the rigours of an underground mining environment. Suitable materials are well known and include aluminium and stainless steel as well as some synthetic materials such as fibreglass and plastics materials.

The discharge pressure may be any pressure required to discharge the emulsion explosives composition from the chamber, preferably no more than about 700 KPa. More preferably, the discharge pressure is in the range of about 200 to 600 KPa.

In order to reduce the resistance to flow of the emulsion explosives composition in a delivery hose or other conduit downstream of the outlet, and therefore facilitate the use of lower discharge pressures, any of a variety of arrangements may be adopted. For example, the passage of the emulsion explosives composition through the delivery hose or conduit may be lubricated as described in GB 2204343 or WO 97/48966 or the flow diameters may be increased as described in WO 97/48966. Alternatively, in some circumstances, it may be appropriate to reduce the viscosity of the emulsion explosives composition. Emulsion explosives compositions may have a standard viscosity of about 14,000 cp to about 30,000 cp, but "runnier" emulsions may be used in which the viscosity is less than 14,000 cp. Preferably, the viscosity is about half of this or even less, for example in the range of about 1,000 to 5,000 cp.

The discharge pressure may be applied to the emulsion explosives composition in the chamber by an incompressible fluid such as water or some other hydraulic fluid. Preferably, however, the discharge pressure is applied by a gas such as compressed air or other pressurised gas. In either case the pressurising medium must be at least substantially inert to the emulsion explosives composition. The supply of a pressurised gas is preferably regulated to ensure smooth flow of the emulsion explosives composition from the chamber. The source of the pressurised gas may be a cylinder, but most preferably the pressurised gas is air and the source is, for example, a pump. In the case of an underground mine, the pump may be the source of pressurised air generally to the mine and therefore may be remote.

The sealable inlet for charging the chamber with emulsion explosives composition may be of any convenient configuration. In a preferred embodiment the inlet is positioned in the top of the chamber in order that the emulsion explosives composition in the unpressurised storage vessel may be readily charged into the chamber with the aid of gravity. Whilst the inlet may be positioned elsewhere within the chamber, such positioning, possibly combined with the viscosity of the emulsion explosives composition, may require the emulsion explosives composition to be pumped into the chamber to achieve an acceptable rate of charging. As discussed above, it is preferable to avoid having to pump emulsion explosives compositions.

The inlet preferably engages the unpressurised storage or supply vessel, such as a tank or hopper or an emulsion manufacturing unit directly, but the engagement may be via a suitable conduit. The vessel may be as large as desired to hold the inventory of emulsion explosives compositions. Since the vessel is unpressurised this will not affect the pV value of the pressure chamber or apparatus.

The inlet is sealable so that when the discharge pressure is applied to the emulsion explosives composition in the chamber the composition is not forced back through the inlet. Closing the inlet can also ensure that a predetermined volume of emulsion explosive is provided in the chamber. A variety of suitable manual or automated valves for closing the inlet will be apparent to those skilled in the art, but in the preferred embodiment, a float valve is employed. Thus, when the emulsion explosive reaches a predetermined level in the chamber, the float is actuated to close the inlet. During discharge of the emulsion explosive from the chamber, the discharge pressure in the chamber may act to keep the float valve closed. In a preferred embodiment, the float is a ball which is adapted to seal the inlet itself.

The position of the outlet within the chamber at least partly defines the shot volume of the chamber since, when the discharge pressure is applied to emulsion explosives composition in the chamber, the volume of emulsion explosives composition above the outlet is discharged. The outlet may be non-adjustable in the chamber in which case the shot volume may be adjusted if desired by charging the chamber with emulsion explosives composition to a variable predetermined level. Such variation may be performed by manually closing the inlet or, for example, in a more complex arrangement by means of adjustable sensors for shutting off the delivery of emulsion explosives composition into the chamber once the predetermined level has been reached. More preferably if variation of the shot volume is desired, the outlet is adjustable within the chamber to allow for control of the shot volume in a simple, mechanical manner. Preferably the outlet comprises a conduit having an inlet opening, and the inlet opening of the outlet may be displaceable within the chamber to provide the aforementioned adjustment of the outlet, for example by sliding the conduit.

Valve sequencing and level control may be controlled using a computer, for instance using computer controlled solenoid valves and sensors. This may permit more accurate control of shot volume, avoidance of splashing of emulsion due to air entering the charging hose, and prevention of siphoning which could lead to loss of containment. Control could be via a radio remote system to start and stop the process. This may allow a single operator to charges holes and control the overall process.

The chamber is preferably vented to atmosphere during charging of the emulsion explosives composition, and preferably a valve permits the pressure medium to pressurise the chamber in a first position and vents the chamber in a second position.

The apparatus of the present invention may be integrated with a delivery system for the delivery of solid particulate materials such as ANFO. In one embodiment a delivery hose for the emulsion explosives composition may be connected by a shuttle valve to the supply of solid particulate material.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

BRIEF DESCRIPTION OF THE DRAWINGS

Two embodiments of apparatus and process for delivering emulsion explosives composition in accordance with the present invention will now be described by way of example only with reference to the accompanying drawings, in which.

DETAILED DESCRIPTION

Figure 1:
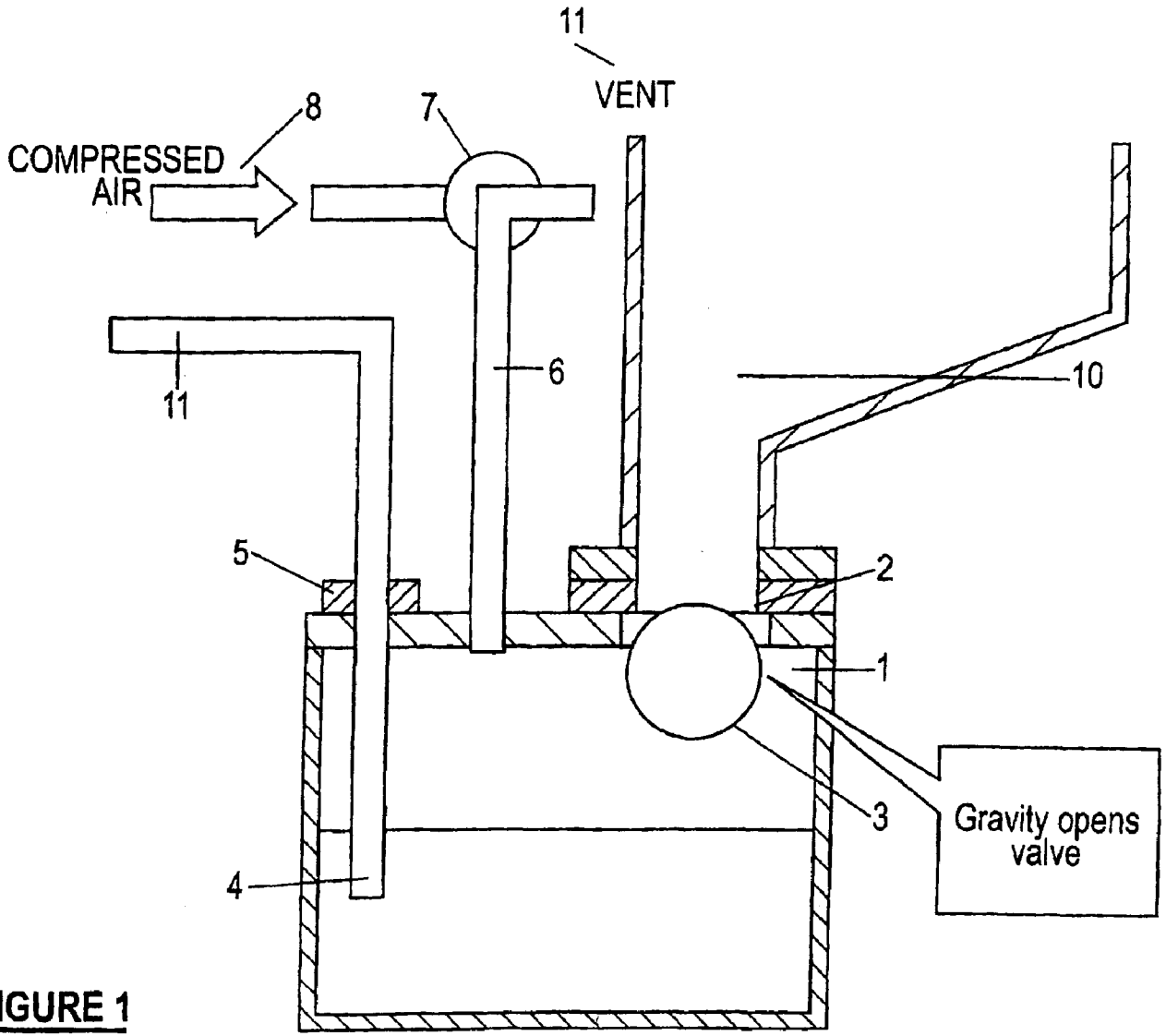
FIG. 1 is a schematic view of a preferred embodiment of apparatus for delivering emulsion explosives composition to a blasthole.

Referring to FIG. 1, the explosives delivery apparatus comprises a chamber 1 having an inlet 2 closable by means of a floating ball valve 3. The inlet 2 is connected to a source of emulsion explosives composition comprising an open hopper 10. The chamber 1 has an outlet 4 in the form of a conduit having a depth within the chamber 1 which if desired could be adjusted by displacement through a sleeve 5, for example by sliding movement. The chamber 1 also has a chamber pressure control means 6 in the form of conduit opening into the chamber and having a valve 7 for selectively connecting chamber 1 to a further conduit 8 leading from a source of compressed air and to a vent 9. The source of compressed air (not shown) is preferably regulated.

In an underground mine the source of compressed air is advantageously the main source of air to the mine. The chamber 1 has a pV value of less than 10 MPaL. Accordingly for a discharge pressure of 200 KPa, the volume of chamber 1 must be less than 50 liters. For a discharge pressure of 600 KPa, the volume must be less than 16.67 liters.

The delivery of emulsion explosives composition from the chamber 1 is controlled by the valve 7. Valve 7 is initially adjusted to allow air at atmospheric pressure within the chamber 1 to vent to atmosphere via the vent 9 as gravity acting on the ball of the ball valve 3 and on the emulsion explosives composition within the hopper 10 forces the ball valve 3 to open. This allows the composition to fill the chamber 1. FIG. 1 illustrates the apparatus just after charging of the emulsion explosives composition into the chamber 1 has started with composition immediately above the level of the outlet conduit opening 4 in the chamber. As the chamber 1 fills, the ball floats on the composition and seals the inlet 2 at a predetermined level of the composition. Emulsion explosives composition in the chamber 1 is delivered by selectively adjusting the valve 7 to connect the chamber 1 to the compressed air conduit 8. The pressure of the compressed air forces the composition within the chamber 1 out through the outlet 4 and holds the ball valve 3 in the inlet in a closed position as the level of the composition drops. If the level of the emulsion explosives composition within the chamber 1 is allowed to fall to immediately below the level of the outlet 4, air is able to flow through the outlet conduit which may serve to clear the conduit and any associated delivery hose 11 (shown schematically in FIG. 1). However, this may result in undesirable splashing of the composition at conduit or hose outlet. The valve 7 may be adjusted to the vent position once the desired volume of the emulsion explosives composition in the chamber has been discharged. When the pressure drops in the chamber 1, the ball automatically drops under gravity and another metered quantity of the emulsion explosives composition is charged into the chamber from the hopper. The ball valve is illustrated schematically and in practice will be guided into the inlet as it floats on the rising level of emulsion explosives composition.

The shot volume, that is the volume of emulsion explosives composition in the chamber 1 above the outlet 4 when the inlet 2 is sealed by the ball valve 3, may be adjusted by sliding the conduit 4 up or down in the sleeve 5. This may be performed before or after the chamber is filled with the composition.

Figure 2:
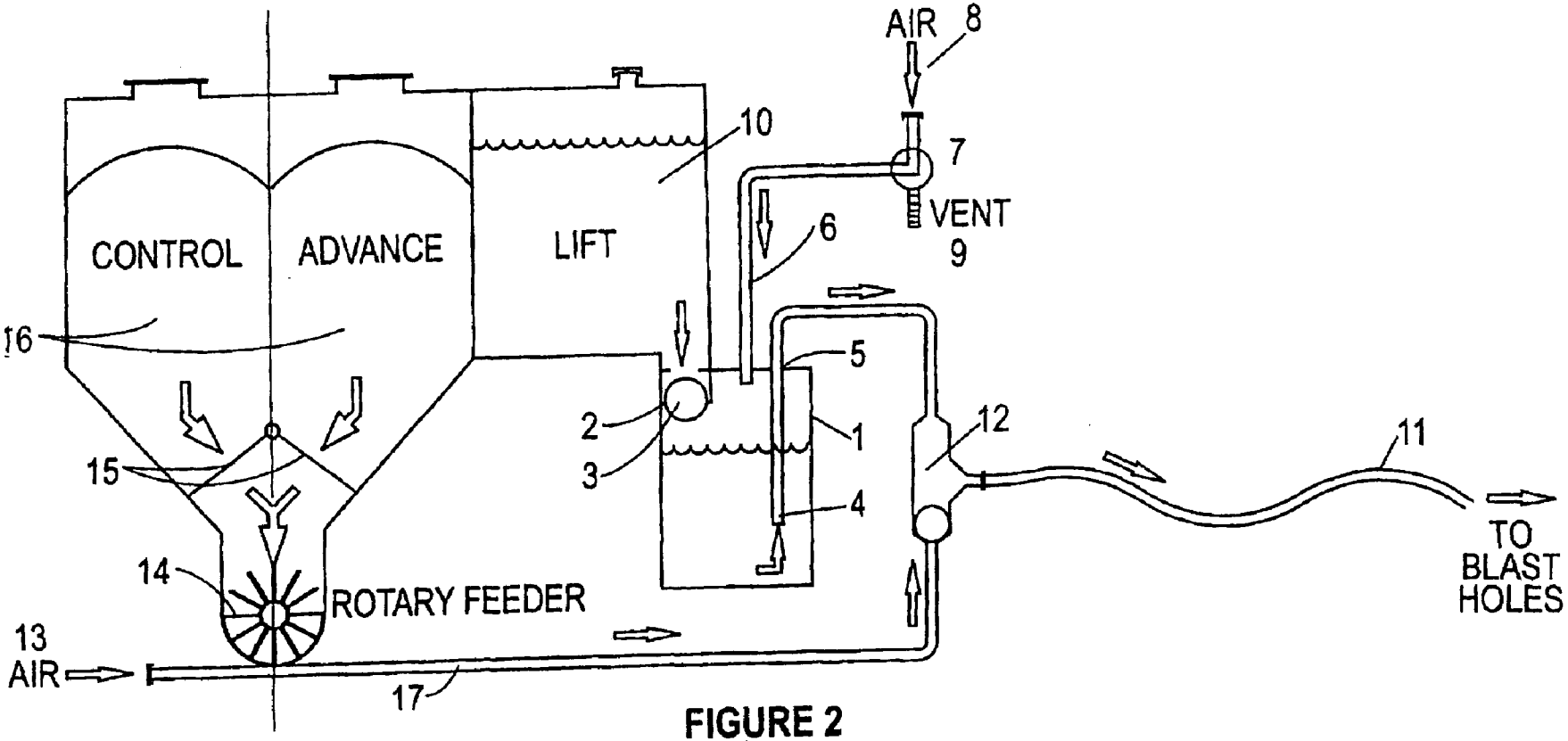
FIG. 2 is a schematic view of the apparatus of FIG. 1 incorporating an apparatus for pneumatic loading of solid particulate materials.

FIG. 2 shows the apparatus of FIG. 1 integrated with a solid particulate feed mechanism which may be used to selectively deliver the emulsion explosives composition from the chamber 1 and/or solid particulate material from one or both of hoppers 16. The delivery of emulsion explosives composition and/or solid particulate material into the delivery hose 18 is determined by a shuttle valve 12, which is controlled by the air pressure.

In order to deliver solid particulate material such as ANFO and/or sensitising solids from chambers 16, gates 15 are selectively opened to feed the solid particulate material into a charge line 17 by means of a rotary feeder 14. The solid particulate material fed in charge line 17 is then delivered to the shuttle valve 12 by the application of compressed air at 13. Substantially equal pressure in the outlet conduit 4 and charge line 14 enables both the emulsion explosives composition and the solid particulate matter to be delivered concurrently and to mix in the shuttle valve 8 and/or in the delivery hose 11.

It will be appreciated from the above description that the preferred embodiment of the apparatus of the invention may be extremely simple and robust and not require any instrumentation for accurate operation. This apparatus may thus be used safely by semi-skilled operators and may allow rapid set-up and close down compared to the available alternatives. This apparatus may also be relatively silent, which is particularly important in underground mines, since it can avoid the use of any pumps. Additionally, with a pV value below 10 MPaL, the vessel defining the chamber avoids being classified as a pressure vessel thereby reducing maintenance and inspection requirements. This also reduces the amount of stored energy in the chamber and provides lower risk to its use.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps, features, compositions and compounds.

The claims defining the invention are as follows:

1. An apparatus for delivering an emulsion explosives composition, the apparatus comprising an unpressurised vessel for storing or supplying the composition to a pressure chamber, a sealable inlet to the chamber for charging the chamber with emulsion explosives composition from the vessel, an outlet from the chamber, and a fluid pressure opening to the chamber for applying a discharge pressure to the chamber for delivering emulsion explosives composition in the chamber through said outlet, wherein the apparatus has a maximum operating pressure and a volume of the pressure chamber such that it has a pressure volume (pV) value of less than 10 MPaL.

2. The apparatus as claimed in claim 1, wherein the pressure required to discharge the emulsion explosives composition from the chamber is no more than about 700 KPa.

3. The apparatus as claimed in claim 2, wherein the discharge pressure is in the range of about 200 to 600 KPa.

4. The apparatus as claimed in any one of claims 1 to 3, wherein the discharge pressure is applied by compressed air or other pressurised gas.

5. The apparatus as claimed in claim 4, wherein the pressurised gas is air and the source is a pump.

6. The apparatus as claimed in claim 1, wherein the inlet is positioned in the top of the chamber in order that the emulsion explosive composition in the unpressurised storage vessel may be readily charged into the chamber with the aid of gravity.

7. The apparatus as claimed in claim 1, wherein the outlet comprises a conduit having an inlet opening, and the inlet opening of the outlet may be displaceable within the chamber to provide the aforementioned adjustment of the outlet by sliding the conduit.

8. A process for the delivery of an emulsion explosives composition comprising the steps of:

a) storing a supply of the composition in an unpressurised vessel;

b) charging a pressure chamber with emulsion explosives composition from the vessel through a sealable inlet to the chamber; and c) applying a discharge pressure to the chamber to discharge emulsion explosives composition in the chamber through an outlet from the chamber;

wherein the discharge pressure and the volume of the pressure chamber are such that the pressure chamber has a pressure volume (pV) value of less than 10 MPaL.

9. The process according to claim 8, wherein the emulsion explosives composition is delivered to a blasthole.

10. The apparatus as claimed in claim 1, wherein the discharge pressure is 200–700 KPa.

11. The apparatus as claimed in claim 1, wherein the discharge pressure is 700 KPa and a maximum volume of the pressure chamber is 14.25 liters.

12. The apparatus as claimed in claim 1, wherein the discharge pressure is 200 KPa and a volume of the pressure chamber is less than 50 liters.

13. The apparatus as claimed in claim 1, wherein the discharge pressure is 600 KPa and a volume of the pressure chamber is less than 16.67 liters.

14. The apparatus as claimed in claim 1, wherein the emulsion explosives composition has a viscosity of less than 14,000 cp.

15. The apparatus as claimed in claim 1, wherein the emulsion explosives composition has a viscosity of 1,000–5,000 cp.

* * * * *